US005516022A

United States Patent [19]

Annis, Jr.

[11] Patent Number: 5,516,022

[45] Date of Patent: May 14, 1996

[54] METHOD AND APPARATUS FOR A TWO SPEED STRAP TAKE UP

[75] Inventor: James R. Annis, Jr., Palatine, Ill.

[73] Assignee: Illinois Tool Works, Inc., Glenview, Ill.

[21] Appl. No.: 202,635

[22] Filed: Feb. 28, 1994

[51] Int. Cl.[6] ..... D06C 15/00

[52] U.S. Cl. ..... 226/25; 226/181; 254/215

[58] Field of Search ..... 226/25, 181, 189; 254/215, 214, 219, 222; 100/2, 39; 464/17, 45, 46, 47

[56] References Cited

U.S. PATENT DOCUMENTS

| | | | |
|---|---|---|---|
| 3,080,148 | 3/1963 | Knoebel et al. | 254/219 |
| 3,319,751 | 5/1967 | Sacchini | 464/17 X |
| 3,349,981 | 10/1967 | Hawkins et al. | 226/181 X |
| 3,420,158 | 1/1969 | Koblella | 100/2 |
| 3,566,778 | 3/1971 | Vllcins | 100/2 |
| 3,600,906 | 8/1971 | Schultz | 464/41 |
| 3,752,058 | 8/1973 | Lems | 100/32 |
| 4,050,372 | 9/1977 | Koblella | 100/2 |
| 4,145,963 | 3/1979 | Leslle et al. | 100/4 |
| 4,301,977 | 11/1981 | Yang | 242/107 |
| 4,328,742 | 5/1982 | Discavage | 100/32 |
| 4,516,488 | 5/1985 | Bartzick et al. | 100/4 |
| 4,536,248 | 8/1985 | Bullington et al. | 156/502 |
| 4,569,186 | 2/1986 | Mori et al. | 53/589 |
| 4,605,456 | 8/1986 | Annis, Jr. | 156/157 |
| 4,635,541 | 1/1987 | Kasuga | 100/2 |
| 4,653,394 | 3/1987 | Kasuga | 100/2 |
| 4,955,180 | 9/1990 | Sakaki et al. | 53/399 |
| 4,968,882 | 11/1990 | Tzeng et al. | 226/45 X |
| 5,092,440 | 3/1992 | Nakano | 464/47 X |
| 5,112,004 | 5/1992 | Tipton | 242/75.51 |
| 5,121,682 | 6/1992 | Parker et al. | 100/26 |

*Primary Examiner*—Lenard A. Footland
*Attorney, Agent, or Firm*—Dvorak and Traub

[57] ABSTRACT

A novel method and apparatus for a two speed strap take up usable in a strapping machine. The two speed strap take up apparatus generally comprises a high speed roller assembly driven by a high speed drive shaft, a low speed roller assembly driven by a low speed drive shaft, a shaft rotation reduction assembly interconnecting the high speed drive shaft and the low speed drive shaft, and a roller clutch assembly interconnecting the shaft rotation reduction assembly and the low speed drive shaft. An input clutch assembly may interconnect the high speed drive shaft and an input drive means. In operation, a strap is disposed between and frictionally engaged by a high speed roller of the high speed roller assembly and a low speed roller of the low speed roller assembly. The low speed roller is then driven in rotation by the high speed roller. When a first tension is applied to the strap, the high speed roller slips relative to the high speed drive shaft until the roller clutch interconnecting the shaft rotation reduction assembly to the low speed drive shaft engages and rotates the low speed drive shaft at a reduced rotation rate relative to the rotation rate of the high speed drive shaft. The strap is now driven by both rollers at the reduced rotation rate as the high speed roller slips relative to the high speed drive shaft. When a second tension, greater than the first tension, is applied to the strap, the low speed roller slips relative to the low speed drive shaft at which time the strapping machine may perform additional functions on the strap.

10 Claims, 3 Drawing Sheets

METHOD AND APPARATUS FOR A TWO SPEED STRAP TAKE UP

FIELD OF THE INVENTION

The present invention relates to a novel method and apparatus for strap take up usable in a strapping machine. Specifically, the invention relates to a novel two speed strap take up method and apparatus that reduces a rate of strap take up in response to increased strap resistance during strap take up.

BACKGROUND OF THE INVENTION

Strapping machines apply a steel or polymeric strap in a sealed tensioned loop about a package to securely bind the package for shipping, storage and merchandising. Strapping machines generally comprise a strap feeding mechanism that forms the strap in a loop which surrounds a package to be bound. A strap take up mechanism then takes up any excess strap and may also apply a tension to the strap so that the strapping machine may perform additional functions on the strap, such as gripping and sealing the strap. It has been suggested to take up strap in a strapping machine by frictionally engaging a portion of the strap disposed between a pair of counter-rotating rollers rotated at a fixed rotation rate by a motor driven shaft journaled to a frame. Fixed rotation rate strap take up mechanisms have the disadvantage that they subject the strap to considerable mechanical stress and damage that may result in breakage of the strap during application of the strap about the package or during later handling of the bound package. Mechanical stress is not limited to the strap but also to the strap take up mechanism which may be subject to considerable frictional forces during strap take up. Mechanical stress to the strap and the strap take up mechanism is compounded by increased tension applied by the strap during strap take up. There exists therefore a demonstrated need for an advancement in the art of strap take up in a strapping machine.

It is an object of the present invention to provide a novel method and apparatus for a strap take up usable in a strapping machine.

It is also an object of the invention to provide a novel method and apparatus for a two speed strap take up usable in a strapping machine.

It is also an object of the invention to provide a novel method and apparatus for a two speed strap take up usable in a strapping machine that reduces a rate of strap take up in response to an increased strap resistance during strap take up.

It is also an object of the invention to provide a novel method and apparatus for a two speed strap take up usable in a strapping machine that is economical to practice and manufacture.

It is another object of the invention to provide a novel method and apparatus for a strap take up usable in a strapping machine that minimizes damage to a strap during take up.

It is a further object of the invention to provide a novel method and apparatus for a two speed strap take up usable in a strapping machine that prevents strap milling.

It is yet a further object of the invention to provide a novel method and apparatus for a two speed strap take up useable in a strapping machine that prevents strap pre-seal.

Accordingly, the present invention is directed toward a novel method and apparatus for a two speed strap take up usable in a strapping machine. The two speed strap take up apparatus generally comprises a high speed roller assembly driven by a high speed drive shaft, a low speed roller assembly driven by a low speed drive shaft, a shaft rotation reduction assembly interconnecting the high speed drive shaft and the low speed drive shaft, and a roller clutch assembly interconnecting the shaft rotation reduction assembly and the low speed drive shaft. An input clutch assembly may interconnect the high speed drive shaft and an input drive means. In operation, a strap is disposed between and frictionally engaged by a high speed roller of the high speed roller assembly and a low speed roller of the low speed roller assembly. The low speed roller is then driven in rotation, in an over-driven condition, by the high speed roller. When a first tension is applied to the strap, the high speed roller slips relative to the high speed drive shaft, this slippage causes rotational speed reduction of both rollers until the roller clutch interconnecting the shaft rotation reduction assembly to the low speed drive shaft engages and rotates the low speed drive shaft at reduced rotation rate relative to the rotation rate of the high speed drive shaft. In one embodiment, the ratio of high to low speed is on the order of 2:1. The high speed roller is then driven in rotation by the low speed roller as the high speed roller slips relative to the high speed drive shaft. When a second tension, greater than the first tension, is applied to the strap, the low speed roller slips relative to the low speed drive shaft at which time both rollers will stop rotating and the strapping machine may perform additional functions on the strap.

These and other objects, features and advantages of the present invention will become apparent upon consideration of the following Detailed Description of the Invention with the accompanying drawings.

DETAILED DESCRIPTION OF THE INVENTION

Figures 1, 2:
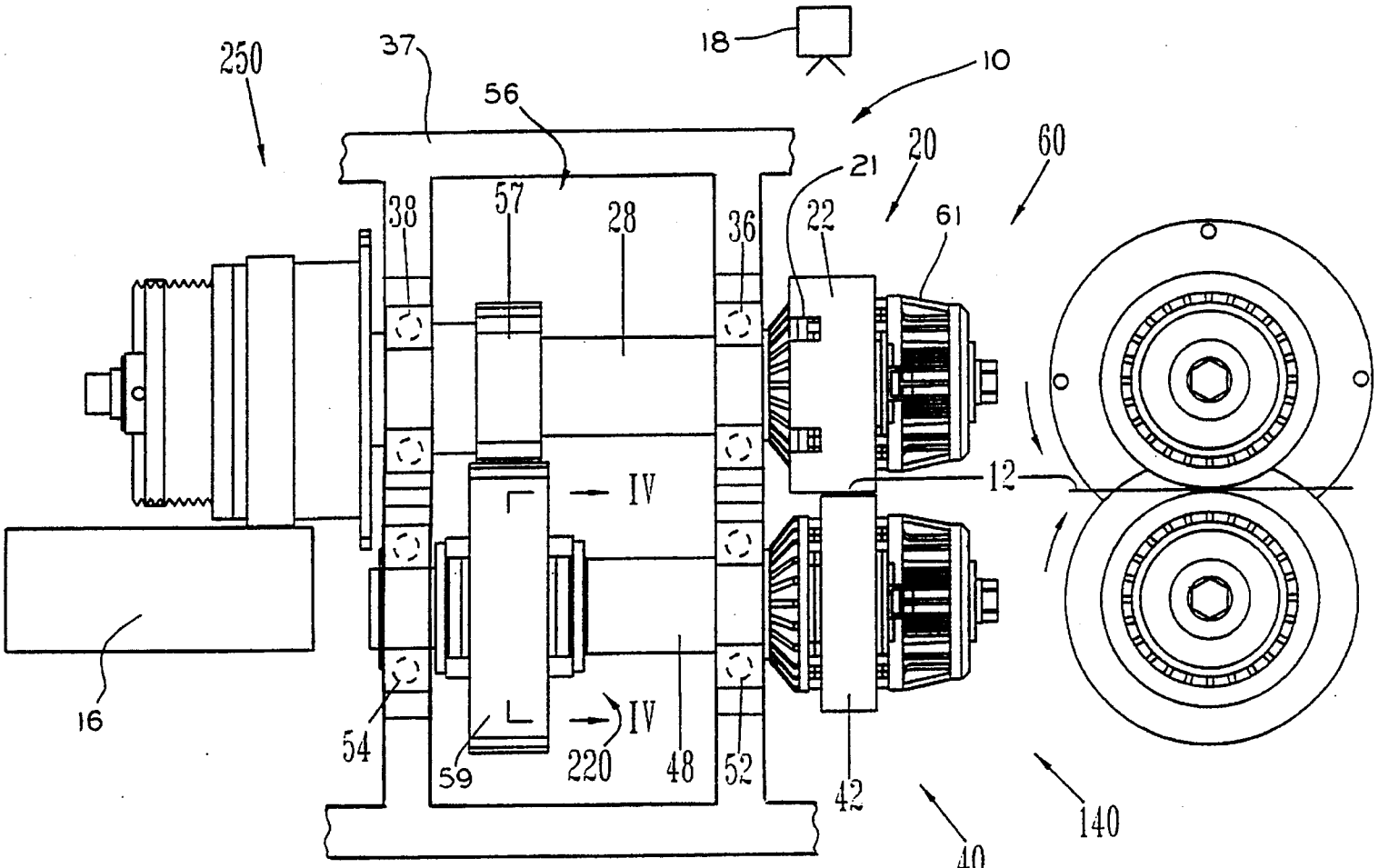
FIG. 1 is a side view of a strap tensioning apparatus usable for strap take up in a strapping machine.
FIG. 2 is an end view of the strap take up apparatus of FIG. 1.
Figure 3:
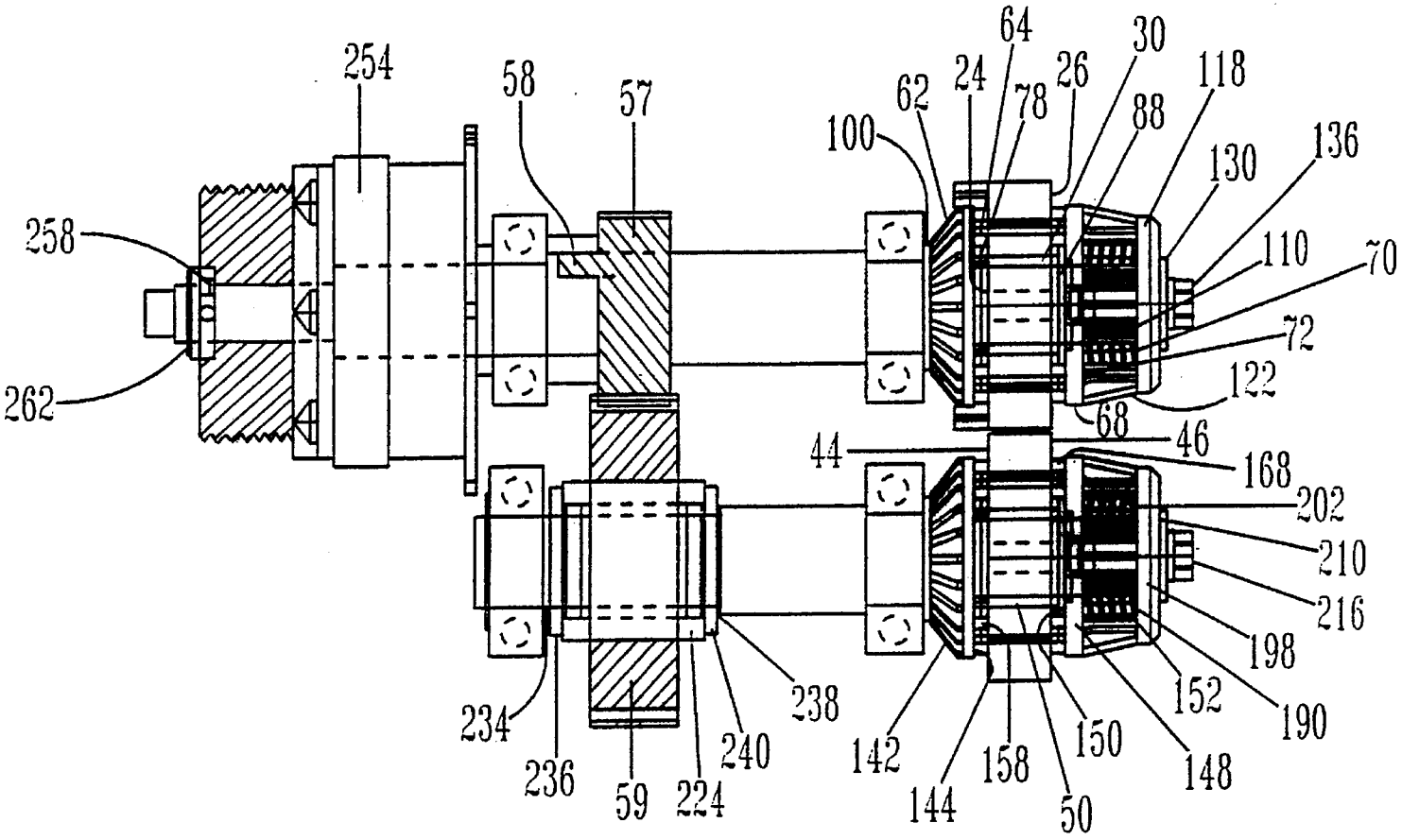
FIG. 3 is a sectional view of the strap take up apparatus of FIG. 1.
Figure 4:
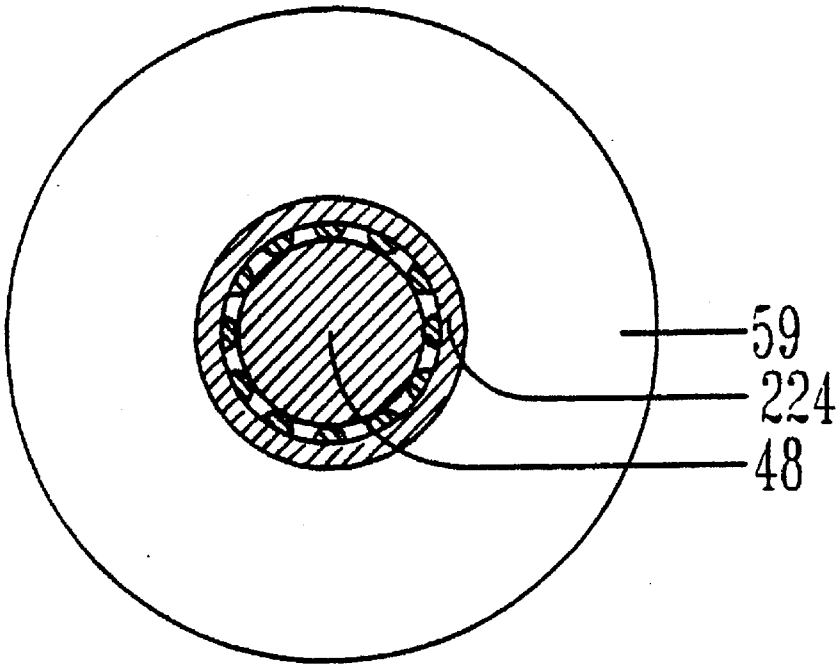
FIG. 4 is a sectional view along lines IV of FIG. 1.

FIG. 1 is a side view of a strap take up apparatus 10 usable for tensioning a strap 12 in a strapping machine. FIG. 2 is an end view of the apparatus. FIG. 3 is a sectional view of the apparatus. FIG. 4 is a sectional view of the apparatus showing the over-running clutch 224 which, in one embodiment, is a shell type roller clutch.

The apparatus 10 generally comprises a high speed roller assembly 20 driven by a high speed drive shaft 28, a low speed roller assembly 40 driven by a low speed drive shaft 48, a shaft rotation reduction assembly 56 interconnecting the high speed drive shaft 28 and the low speed drive shaft 48, and a roller clutch assembly 220 interconnecting the shaft rotation reduction assembly 56 and the low speed drive shaft 48. An input clutch assembly 250 comprising an input clutch 254 coupled to the shaft 28 by a key 258 and secured by retaining ring 262, interconnects the high speed drive shaft 28 and an input drive means not shown in the drawings. In one embodiment, the drive means comprises a belt. The strap 12 may be frictionally engaged by the high speed roller assembly 20 and the low speed roller assembly 40 to take up the strap 12 for further processing of the strap 12 by the strapping machine.

The high speed tension roller assembly 20 comprises a high speed roller 22 with an inner surface 24 and an outer surface 26 that is rotatably coupled to the high speed drive shaft 28 by a bearing 30. The drive shaft 28 is rotatable on a front journal bearing 36 and a rear journal bearing 38 both of which are disposed on a journal box not shown in the drawings. A low tension slip clutch assembly 60 interconnects the high speed roller 22 and the drive shaft 28. The clutch assembly 60 includes an inner slip plate 62 with a slip surface 64 disposed proximate the inner surface 24 of the high speed roller 22 and an outer slip plate 68 with an outer slip surface 70 disposed proximate the outer surface 26 of the high speed roller 22. The inner slip plate 62 and the outer slip plate 68 may both include large surface areas such as radial fins for dissipating heat that may accumulate during operation. An inner slip disk 78 is disposed between the inner surface 24 of the high speed roller 22 and the slip surface 64 of the inner slip plate 62. An outer slip disk 88 is disposed between the outer surface 26 of the high speed roller 22 and the outer slip surface 70 of the outer slip plate 68. The outer slip plate 68 also includes a spring retaining surface 72 for receiving one or more die springs 110 which are compressed between an inner spring retaining surface 122 of die spring plate 118 and the spring retaining surface 72 of the outer slip plate 68 to bias the outer slip plate 68 toward the inner slip plate 62 and frictionally engage the high speed roller 22 therebetween. A lock washer 130 and a retaining nut 136 secured to the drive shaft 28 retain the die spring plate 118 against the force of the die springs 110. The biasing force of the die springs 110 may be adjustable. An inner retaining ring 100 is disposed between the front journal bearing 36 and the inner slip plate 62. Those of ordinary skill in the art will understand and appreciate that the high speed roller assembly disclosed above is an exemplary embodiment and that equivalent and alternative embodiments may also exist.

The low speed roller assembly 40 comprises a low speed roller 42 with an inner surface 44 and an outer surface 46 that is rotatably coupled to the low speed drive shaft 48 by a bearing 50. The drive shaft 48 is rotatable on a front journal bearing 52 and a rear journal bearing 54 both of which are disposed on the journal box not shown in the drawings. A high tension slip clutch assembly 140 interconnects the low speed roller 42 and the drive shaft 48. The clutch assembly 140 includes an inner slip plate 142 with a slip surface 144 disposed proximate the inner surface 44 of the low speed roller 42 and an outer slip plate 148 with an outer slip surface 150 disposed proximate the outer surface 46 of the low speed roller 42. The inner slip plate 142 and the outer slip plate 148 may both include large surface areas such as radial fins for dissipating heat that may accumulate during operation. An inner slip disk 158 is disposed between the inner surface 44 of the low speed roller 42 and the slip surface 144 of the inner slip plate 142. An outer slip disk 168 is disposed between the outer surface 46 of the low speed roller 42 and the outer slip surface 150 of the outer slip plate 148. The outer slip plate 148 also includes a spring retaining surface 152 for receiving die springs 190 which are compressed between an inner spring retaining surface 202 of die spring plate 198 and the spring retaining surface 152 of the outer slip plate 148 to bias the outer slip plate 148 toward the inner slip plate 142 and frictionally engage the low speed tension roller 42 therebetween. A lock washer 210 and retaining nut 216 secured to the drive shaft 48 retain the die spring plate 198 against the force of the die springs 190. The biasing force of the die springs 198 may be adjustable. Those of ordinary skill in the art will understand and appreciate that the low speed roller assembly disclosed above is an exemplary embodiment and that equivalent and alternative embodiments may also exist.

The rotation reduction assembly 56 interconnects the high speed drive shaft 28 of the high speed roller tension assembly 20 and the low speed drive shaft 48 of the low speed roller assembly 40. The rotation reduction assembly 56 comprises a drive gear 57 securely disposed about the high speed drive shaft 28 by a drive gear key 58 and a reducing gear 59 disposed about the low speed tension drive shaft 48. Additionally, an over-running clutch assembly 220 comprising a shell type roller clutch 224 interconnects the reducing gear 59 and the low speed tension drive shaft 48. The shell type roller clutch 224 transmits torque in one direction and allows free-wheeling in an opposite direction. The high speed drive shaft 28 and the drive gear 57 rotate at the same rotation rate $w_{high}$. The drive gear 57 engages and rotates the reducing gear 59 at a reduced rotation rate $w_{low}$ relative to the rotation rate $w_{high}$ of the high speed drive shaft 28 and the drive gear 57. The torque of the reducing gear 59 rotating at the rotation rate $w_{low}$ may be transmitted to the low speed drive shaft 48 by the shell type roller clutch 224. The shell type roller clutch 224 permits the low speed drive shaft 48 to rotate at a rotation rate greater than the rotation rate $w_{low}$ of the reducing gear 59 but never at a rotation rate less than the rotation rate $w_{low}$ of the reducing gear 59. A first combination sealing ring 236 and thrust spacer 234 are disposed on one side of the reducing gear 59 and a second combination sealing ring 240 and thrust spacer 238 are disposed on an opposing side of the reducing gear 59. Those of ordinary skill in the art will understand and appreciate that the rotation reduction assembly disclosed above is an exemplary embodiment and that equivalent and alternative embodiments may also exist.

In operation, the input drive means not shown in the drawing drives the high speed drive shaft 28, the drive gear 57, and the high speed roller 22 at the rotation rate of $w_{high}$ via the input clutch assembly 250. A strap 12 may be disposed between and frictionally engaged by the high speed roller 22 and the low speed roller 42 to take up the strap 12 for further processing of the strap 12 by the strapping machine. In one embodiment, the roller surfaces of rollers 22 and 42 are relatively smooth. The frictional forces on a strap 12 disposed between the high speed roller 22 and the low speed roller 42 imparts the torque of the high speed roller 22 to the low speed roller 42 thereby rotating the low speed roller 42 and the low speed drive shaft 48 at substantially the same rotation rate $w_{high}$ as the high speed roller 22 and the high speed drive shaft 28. The high speed roller 22 is then driving the low speed roller 42. As discussed above, the shell type roller clutch 224 permits the low speed drive shaft 48 to rotate at a rotation rate greater than the rotation rate $w_{low}$ of the reducing gear 59. As the tension on the strap 12 is increased to a tension $T_1$, the high speed roller 22 begins to slip relative to the inner slip plate 62 and the outer slip plate 68 of the low tension slip clutch assembly 60 thereby decreasing the rotation rate of the high speed roller 22 to a reduced variable level $w_r$ relative to the rotation rate $W_{high}$ of the high speed drive shaft 28, where $w_r$ is less than $w_{high}$. The reduced force of the high speed roller 22 is, accordingly, imparted to the low speed roller 42 by the frictional forces imposed by the strap 12 as discussed above thereby reducing the rotation rate of the low speed roller 42 to substantially the same rotation rate $w_r$ of the high speed roller 22. Tension on the strap 12 will continue to decrease the rotation rate $w_r$ of the high speed roller 22 and the low speed roller 42 until the rotation rate $w_r$ is equal to the rotation rate $w_{low}$ of the reducing gear 59. When the rotation rate $w_r$ is equal to the rotation rate $w_{low}$, the shell type roller clutch 224 engages the low speed drive shaft 48 and maintains the rotation rate of the low speed drive shaft 48 and the low speed drive roller 42 at $w_{low}$. The low speed roller 42 then drives the strap via the high tension slip clutch assembly 140 at the rotation rate $w_{low}$. As the tension on the strap 12 is increased to a tension level $T_2$, greater than $T_1$, the low speed roller 42 begins to slip relative to the inner slip plate 142 and the outer slip plate 148 of the high tension slip clutch assembly 140. In one embodiment, this slippage could be sensed optically by a proximity sensor. At this time both the high speed roller 22 and the low speed roller 42 will stop rotating and the strapping machine may perform additional functions on the strap 12.

The foregoing description will enable one of ordinary skill in the art to make and use the preferred embodiments of the present invention. It will be appreciated by those skilled in the art that there exists variations, modifications and equivalents to the embodiments disclosed herein. The present invention therefore is to be limited only by the scope of the appended claims.

What is claimed is:

1. An apparatus usable for a strap take up of a strap useable within a strapping machine, the apparatus comprising:

a high speed roller assembly having a high speed roller continuously rotatable in one operational direction by a high speed rotatable drive shaft disposable in a journal box, the high speed rotatable drive shaft rotatable by a power drive train said power drive train continuously operable in said same one direction;

a low speed roller assembly having a low speed roller continuously rotatable in another operational direction by a low speed rotatable drive shaft said another operational direction opposite to said one direction, the strap being simultaneously disposable between and frictionally engageable by the high speed roller and the low speed roller;

a reduction gear assembly having a reducing gear disposed about the low speed rotatable drive shaft, the reduction gear assembly interconnecting the high speed rotatable drive shaft and the low speed rotatable drive shaft, the low speed rotatable drive shaft being rotated by the reducing gear at a reduced rotation rate relative to the high speed rotatable drive shaft;

a roller clutch interconnecting the reducing gear and the low speed rotatable drive shaft, the roller clutch allowing the low speed rotatable drive shaft to rotate at a rotation rate greater than a rotation rate of the reducing gear but not at a rotation rate less than the rotation rate of the reducing gear;

a low tension clutch assembly interconnecting the high speed roller and the high speed rotatable drive shaft, the low tension clutch allowing slippage between the high speed roller and the high speed rotatable drive shaft when a first and continuously progressive tension is applied to the strap disposed between the high speed roller and the low speed roller and when said first tension progressively attains a first pre-etermined value and a first strap take up speed; and a high tension clutch assembly interconnecting the low speed roller and the low speed rotatable drive shaft, the high tension clutch allowing slippage between the low speed roller and the low speed rotatable drive shaft when a second and continuously progressive tension which said second tension is greater than the first tension, is applied to the strap disposed between the high speed roller and the low speed roller and when said second tension progressively attains a second pre-determined value and a second strap take up speed, wherein said second strap tensioning is correspondingly carried out at a take up speed slower than said first strap take up speed, said second tension being applied to said strap until said low speed roller slips relative to said low speed drive shaft, thereby minimizing damage to the strap.

2. The apparatus of claim 1 wherein the roller clutch comprises a one-way ratchet means for applying a torque in one direction while being free-wheeling in an opposite direction.

3. The apparatus of claim 2 further comprising a low tension clutch means interconnecting the high speed roller and the high speed rotatable drive shaft, the high speed roller being rotatable relative to the high speed rotatable drive shaft, the low tension clutch means having a first inner slip plate fixedly disposed about the high speed rotatable drive shaft on one side of the high speed roller and a first outer slip plate fixedly disposed about the high speed rotatable drive shaft on an opposing side of the high speed roller, wherein the first inner slip plate and the first outer slip plate frictionally engage and rotate the high speed roller until the first tension is applied to the strap causing the high speed roller to slip relative to the high speed rotatable drive shaft.

4. The apparatus of claim 3 further comprising a high tension clutch means interconnecting the low speed roller and the low speed rotatable drive shaft, the low speed roller being rotatable relative to the low speed rotatable drive shaft, the high tension clutch means having a second inner slip plate fixedly disposed about the low speed rotatable drive shaft on one side of the low speed roller and a second outer slip plate fixedly disposed about the low speed rotatable drive shaft on an opposing side of the low speed roller, wherein the second inner slip plate and the second outer slip plate frictionally engage and rotate the low speed roller until the second tension is applied to the strap causing the low speed roller to slip relative to the low speed rotatable drive shaft.

5. The apparatus of claim 4 further comprising a first slip disk disposed between the first inner slip plate and the high speed roller, a second slip disk disposed between the first outer slip plate and the high speed roller, a third slip disk disposed between the second inner slip plate and the low speed roller, and a fourth slip disk disposed between the second outer slip plate and the low speed roller.

6. The apparatus of claim 5 further comprising a first means for biasing the first outer slip plate toward the first inner slip plate to frictionally engage the high speed roller therebetween, and a second means for biasing the second outer slip plate toward the second inner slip plate to frictionally engage the low speed roller therebetween.

7. The apparatus of claim 4 further comprising cooling fins disposed on the high speed roller assembly and the low speed roller assembly, a drive gear fixedly disposed about the high speed drive shaft and engageable with the reduction gear of the low speed shaft, and notches on the high speed roller which are sensed optically by a proximity sensor.

8. The apparatus of claim 4 further comprising an input clutch interconnecting the high speed drive shaft and the power drive train.

9. An apparatus usable for a strap take up of a strap useable within a strapping machine, the apparatus comprising:

a high speed roller assembly having a high speed roller continuously rotatable in one operational direction by a high speed rotatable drive shaft disposable in a journal box, the high speed rotatable drive shaft rotatable by a power drive train said power drive train continuously operable in said same one direction;

a low speed roller assembly having a low speed roller continuously rotatable in another operational direction by a low speed rotatable drive shaft disposable in a journal box said another operation direction opposite to said one direction, the strap being disposable between and frictionally engaged by the high speed roller and the low speed roller;

a reduction gear assembly having a reducing gear disposed about the low speed rotatable drive shaft, the reduction gear assembly interconnecting the high speed rotatable drive shaft and the low speed rotatable drive shaft, the low speed rotatable drive shaft being rotated by the reduction gear at a reduced rotation rate relative to the high speed rotatable drive shaft;

means for allowing the low speed rotatable drive shaft to rotate at a rotation rate greater than the reduced rotation rate relative to the high speed rotatable drive shaft;

means for allowing the high speed roller to slip relative to the high speed rotatable drive shaft when a first and continuously progressive tension is applied to the strap disposed between the high speed roller and the low speed roller and when said first tension progressively attains a first pre-determined tension value and a first take up speed;

means for allowing the low speed roller to slip relative to the low speed rotatable drive shaft when a second and continuously progressive tension which said second tension is greater than the first tension, is applied to the strap disposed between the high speed roller and the low speed roller and when said second tension progressively attains a second pre-determined tension value and a second strap take up speed, said second tension being applied to said strap until said low speed roller slips relative to said low speed drive shaft.

10. A method for two speed strap take up usable in a strapping machine, the method comprising steps of:

simultaneously engaging a strap between a high speed roller and a low speed roller, the high speed roller being continuously rotated in one operational direction by a high speed drive shaft and the low speed roller being rotated continuously at substantially a same rotation rate as the high speed roller and in another operational direction, said another direction being opposite to said one direction;

slipping the high speed roller relative to the high speed drive shaft when a first and continuously progressive tension is applied to the strap and when said first tension progressively attains a first pre-determined value and a first take up speed;

rotating the low speed roller by a low speed drive shaft when the high speed roller slips relative to the high speed drive shaft, wherein the low speed drive shaft is being driven at a reduced rotation rate relative to the high speed drive shaft by a reducing gear assembly interconnecting the high speed drive shaft and the low speed drive shaft; and slipping the low speed roller relative to the low speed drive shaft when a second and continuously progressive tension which said second tension is greater than the first tension, is applied to the strap and when said second tension progressively attains a second pre-determined value and a second take up speed.

* * * * *